US011421288B2

(12) United States Patent
Levine et al.

(10) Patent No.: US 11,421,288 B2
(45) Date of Patent: Aug. 23, 2022

(54) ULTRA FORMED LEATHER MOLDING

(71) Applicant: Asher Levine Inc., Los Angeles, CA (US)

(72) Inventors: Asher Levine, Los Angeles, CA (US); Tyson Tabbert, Los Angeles, CA (US)

(73) Assignee: Asher Levine Inc., Los Angeles, CA (US)

( * ) Notice: Subject to any disclaimer, the term of this patent is extended or adjusted under 35 U.S.C. 154(b) by 37 days.

(21) Appl. No.: 16/812,143

(22) Filed: Mar. 6, 2020

(65) Prior Publication Data

US 2020/0208228 A1 Jul. 2, 2020

Related U.S. Application Data

(63) Continuation of application No. PCT/US2018/050093, filed on Sep. 7, 2018.

(60) Provisional application No. 62/556,251, filed on Sep. 8, 2017.

(51) Int. Cl.

| | |
|---|---|
| ***C14B 1/30*** | (2006.01) |
| ***B68F 1/00*** | (2006.01) |
| ***C14B 5/02*** | (2006.01) |
| ***A41D 1/00*** | (2018.01) |

(52) U.S. Cl.

CPC ..... *C14B 1/30* (2013.01); *A41D 1/00* (2013.01); *B68F 1/00* (2013.01); *C14B 5/02* (2013.01)

(58) Field of Classification Search

None

See application file for complete search history.

(56) References Cited

U.S. PATENT DOCUMENTS

| | | | | |
|---|---|---|---|---|
| 5,480,605 | A * | 1/1996 | Skaalen, Jr. | B68F 1/00 264/234 |
| 2004/0137103 | A1 | 7/2004 | Lin | |
| 2013/0087942 | A1 | 4/2013 | Kimishima | |
| 2013/0154165 | A1* | 6/2013 | Wu | B68F 1/00 264/571 |
| 2016/0102940 | A1* | 4/2016 | Sykes | B32B 27/308 224/587 |

FOREIGN PATENT DOCUMENTS

| | | | |
|---|---|---|---|
| JP | 2001259264 | A | 9/2001 |
| NL | 62838 | C | 11/1948 |
| RU | 2295270 | C2 | 3/2007 |

OTHER PUBLICATIONS

Extended European Search Report dated Apr. 20, 2021, Patent Application No. 18853895.3, 9 pages.

International Search Report and Written Opinion dated Dec. 13, 2018, International Patent Application No. PCT/US2018/050093, filed Sep. 7, 2018, 8 pages.

JPH01232990, issued Sep. 18, 1989, Masaki Matsuda.

JPH07138600, issued May 30, 1995, Yasuaki Yokota, et al.

JPH01146737, issued Jun. 8, 1989, Takao Horikawa, et al.

WO2011161761, issued Dec. 29, 2011, Masumi Kimishima.

* cited by examiner

*Primary Examiner* — Alexander S Thomas

(74) *Attorney, Agent, or Firm* — Davis Wright Tremaine LLP

(57) ABSTRACT

Leather and similar materials are formed using graduated molds. A solvent is applied to the leather to saturate the leather. The saturated leather is put through a series of molds, each being more pronounced than the previous. An elastomer is applied after molding to provide structural support for features created through molding.

14 Claims, 6 Drawing Sheets

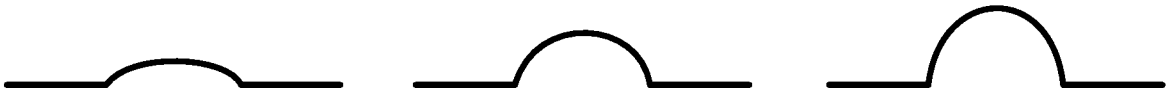
FIG. 1
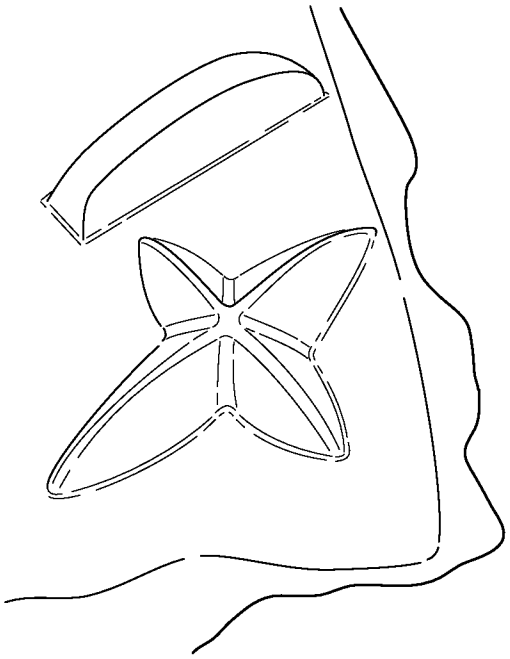
FIG. 2A
FIG. 2B
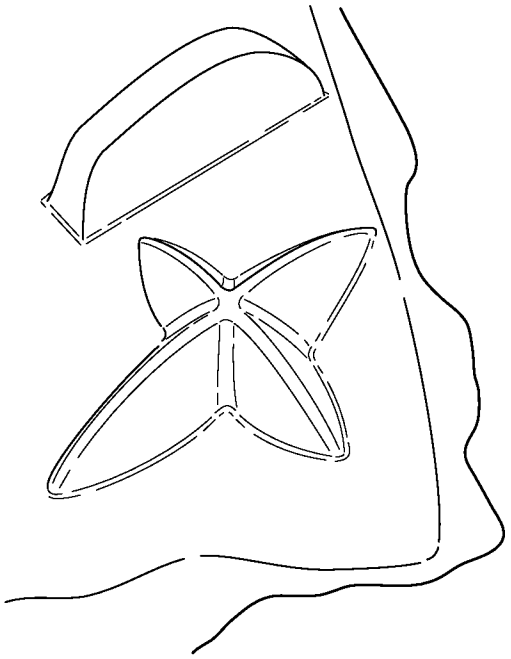
FIG. 2C

ULTRA FORMED LEATHER MOLDING

CROSS-REFERENCE TO RELATED APPLICATIONS

This application is continuation of international application No. PCT/US2018/050093, filed Sep. 7, 2018, entitled "ULTRA FORMED LEATHER MOLDING," which claims priority from U.S. Provisional Patent Application No. 62/556,251, filed Sep. 8, 2017, entitled "ULTRA FORMED LEATHER MOLDING USING PERFORMANCE ELASTOMERS," the disclosures of which are hereby incorporated herein in their entirety.

BACKGROUND

While various techniques have been developed to give leather and similar materials various surface features, these techniques typically have limited effect. For example, conventional techniques for leather embossing allow for some surface ornamentation, but the effect is generally limited. Producing larger surface effects has various obstacles. For example, stresses on the leather can cause the leather to rip. Other techniques often involve significant labor and/or additional materials.

BRIEF DESCRIPTION OF THE DRAWINGS

Various techniques will be described with reference to the drawings, in which:

FIG. 1 is a diagram exhibiting incremental mold techniques;

FIGS. 2A-2C shows successive results of using graduated molds on leather to achieve greater deformation as graduations are applied in sequence;

DETAILED DESCRIPTION

Figure 3:
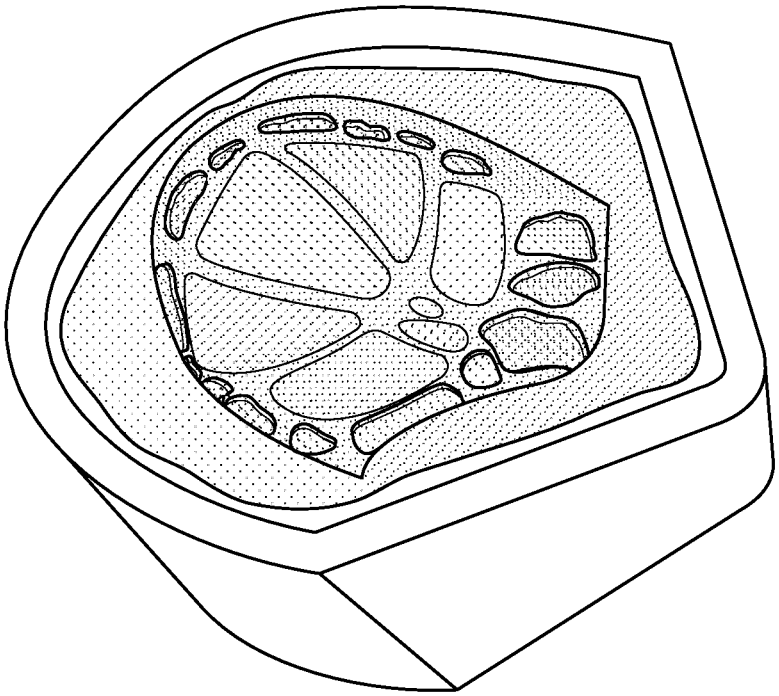
FIG. 3 shows an example outer mold with a piece of leather (shown semi-transparently) being ready to receive an inner mold to be deformed.
Figure 4:
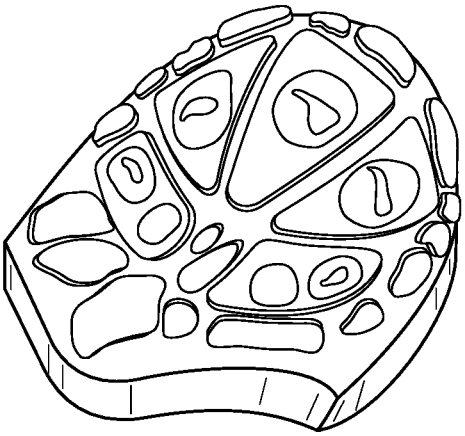
FIG. 4 shows an example of an inner mold that is a complement to the outer mold of FIG. 3.
Figure 5:
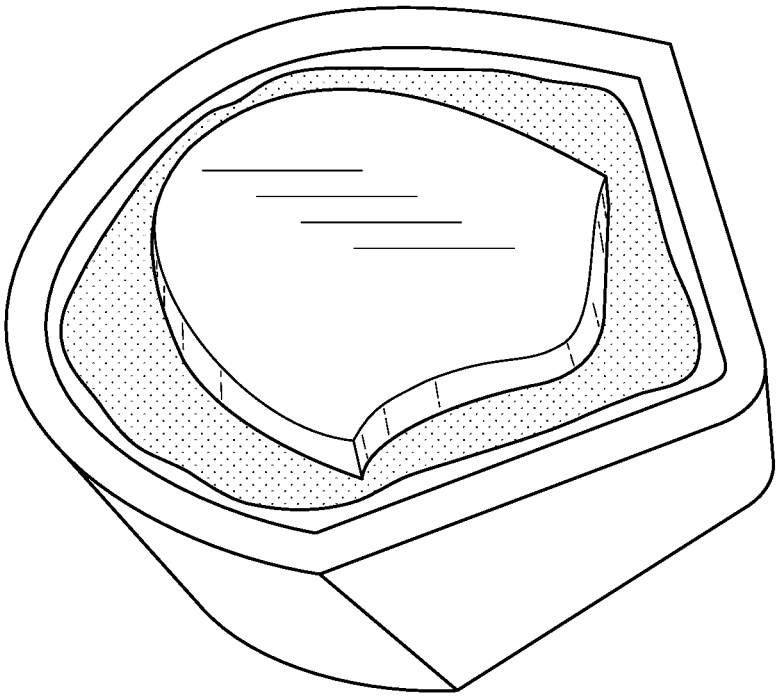
FIG. 5 shows an example of a piece of leather between the outer mold of FIG. 3 and the inner mold of FIG. 4.
Figure 6:
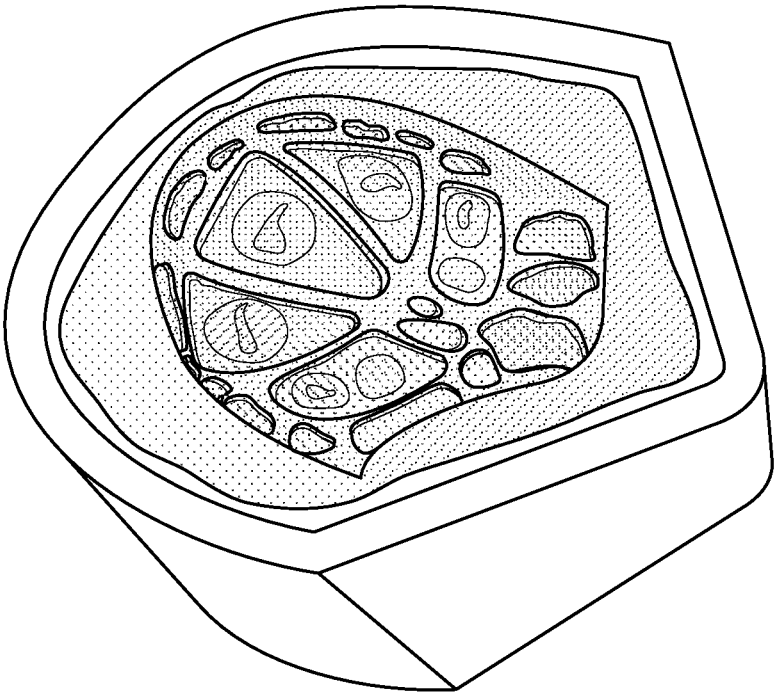
FIG. 6 shows leather after having gone through a molding process, but still in the outer mold of FIG. 3.

Techniques described and suggested herein relate to the production of ultra formed leather (e.g., leather formed to have pronounced shapes) in a way that utilizes specific molding methodologies and high performance polymers to bend and shape natural and synthetic leathers. Such techniques are applicable in various industries, such as those involving apparel, fashion accessories, interior decor, furniture products, and automotive applications, among others.

In the preceding and following description, various techniques are described. For purposes of explanation, specific configurations and details are set forth in order to provide a thorough understanding of possible ways of implementing the techniques. However, it will also be apparent that the techniques described below may be practiced in different configurations without the specific details. Furthermore, well-known features may be omitted or simplified to avoid obscuring the techniques being described.

In an embodiment, a method, comprises: placing leather between a first negative mold and a first positive mold; applying pressure to cause the first negative mold and the first positive mold to form an area of the leather; placing the area of the leather between a second negative mold and a second positive mold; and applying pressure to cause the second negative mold and second positive mold to further form the leather. The first negative mold may have a higher hardness than the first positive mold. The method may further comprise applying a stretch solvent to the leather prior to placing the leather between the first negative mold and the first positive mold. In an embodiment, the second positive mold protrudes further from a surface than the first positive mold. An elastomer may be applied to the leather after applying pressure to cause the second negative mold and the second positive mold to further form the leather. In an embodiment the elastomer is a thermoset rubber and/or latex or another bio-sustainable material. In another embodiment, the elastomer is applied as a sheet that is pressed into the leather. Pressure may be applied by increasing the pressure over a period of multiple hours. The pressure may be maintained for at least multiple hours. The method may further comprise applying a textile to provide structural support for the further formed leather. The method may also further comprise: placing the area of the leather between a third negative mold and a third positive mold; and applying pressure to cause the third negative mold and third positive mold to further form the leather.

In some embodiments, the first positive mold, the second positive mold, and the third positive mold are graduations toward a destination shape to be molded into the leather. The first positive mold, the second positive mold, and the third positive mold may have different hardness. The method may further comprise saturating the leather with a stretch solvent after further forming the leather and may also further comprise placing the area of the saturated leather between the second negative mold and the second positive mold; and applying pressure to cause the second negative mold and second positive mold to further form the saturated leather. Embodiments herein also include a piece of leather at least partially produced using the method of any preceding claim and an article of clothing produced using the piece of leather.

Process:

Choosing the Right Material

Numerous types of leathers and synthetic leathers can be formed utilizing techniques described herein. Depending on how the leather is processed yields the ideal properties for maximum molding and capturing the most detail. Leathers processed with oils and finished with wax have the best strength and ultimate stability. Skiving the leather improves its forming, and each processed skins should be tested to find its maximum elongation. Leathers can be formed using variations of this technique include, but are not limited to: Lamb; Goat; Cow; other Bovine; Python & Lizard; Amphibian; Bird; Fish and Marine Skins; Lab Grown and Synthetic Skins, lab grown collagen leathers, mycelium leathers, and leathers derived from bio-waste or other leathers classified as sustainable. Some leathers with PVC or other plastic finishing, such as patent leather, can prevent detail and overall molding.

Design Generation

The design is the desired final shape of the leather. It can be made or generated through, but not limited to: Clay Sculpture; 3D Printed; Castings from existing objects; and/or other techniques.

Mold Overview

In an embodiment, the Mold is made of 2 basic parts, the Outer and Inner components. The Outer mold (also referred to as the "outer" or the "negative mold"). The Outer mold is the negative of the design, in an embodiment. For example, if the design is to include an outward protrusion, the outer mold may be concave to form the outer part of the protrusion. This mold can be made in a variety of materials to suit both prototyping and industrial purposes. The outer mold is at least one part, and can be made in multiple units to achieve a variety of detail up to 360 degrees. The term "degrees" used herein is a measure of deformation of a leather sheet. With respect to a plane intersecting a concave space formed by the deformation of a sheet of leather, a deformation that caused the sheet to completely enclose a circle on the plane would be considered to be deformed 360 degrees along that plane. A deformation can deform up to 360 degrees on some or all such planes. The general recommended properties of the Outer are as follows, and can vary depending on characteristics of material:

Tensile Strength—at least 3,000 psi

Compressive Strength—at least 4,000 psi

Tensile Modulus—at least 139,000 psi

Shore Hardness D—at least 70D

Other values, including values approximately equal to the above values may also be used to achieve the same effect. The Outer, in an embodiment, is very hard and difficult to distort. It can be made in resin elastomers that exhibit the desired properties, or in metal for industrial purposes.

The Inner mold (also referred to as the "inner" or the "positive mold"). The Inner mold, in an embodiment, is the positive of the design. This mold can be made in a variety of materials to suit both prototyping and industrial purposes. The inner mold may be one part and may represent the final design. The general recommended properties of the Inner are as follows, and can vary depending on the characteristics of the material:

Tensile Strength—2264 psi

100% Modulus—855 psi

Shore Hardness D—30D

Other values, including values approximately equal to the values discussed above may also be used to achieve the same effect. These properties, like the hardness of a car tire, of the Inner give the resistance the leather needs to be formed into the negative mold, yet yield to the leather adequately as to avoid damage and squeeze into undercuts in the positive. It can be made in high performance thermoset elastomers for prototyping or thermoplastic rubbers that are injection molded for industrial purposes.

Figure 7:
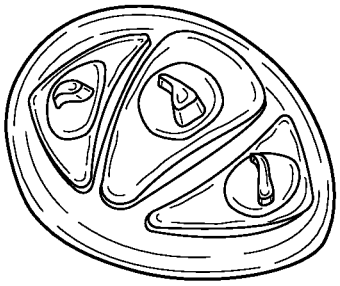
FIG. 7 shows a mold extender to provide additional deformation within a portion of a piece of leather being deformed.
Figure 8:
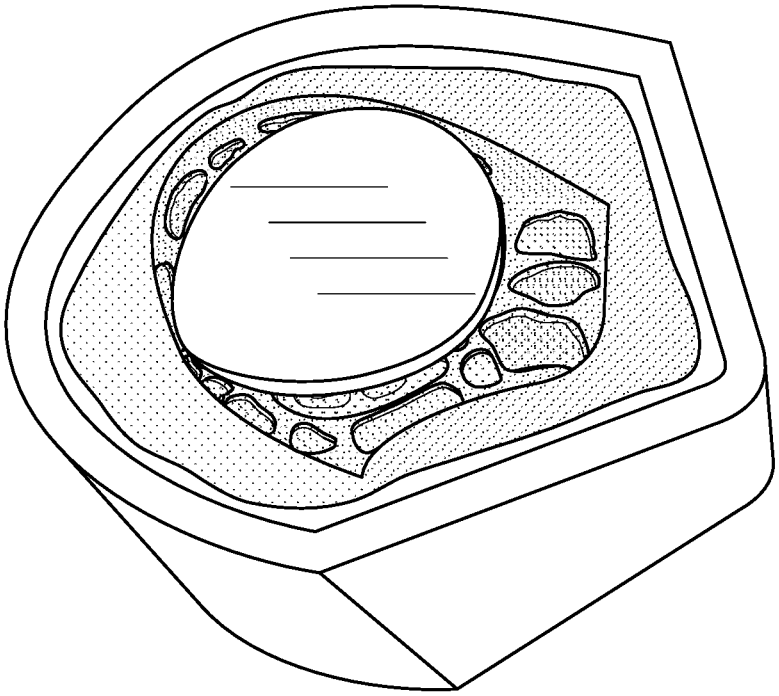
FIG. 8 shows a mold extender being used to deform a portion of a piece of leather by being applied to a portion of the piece of leather in the outer mold of FIG. 3.
Figure 9:
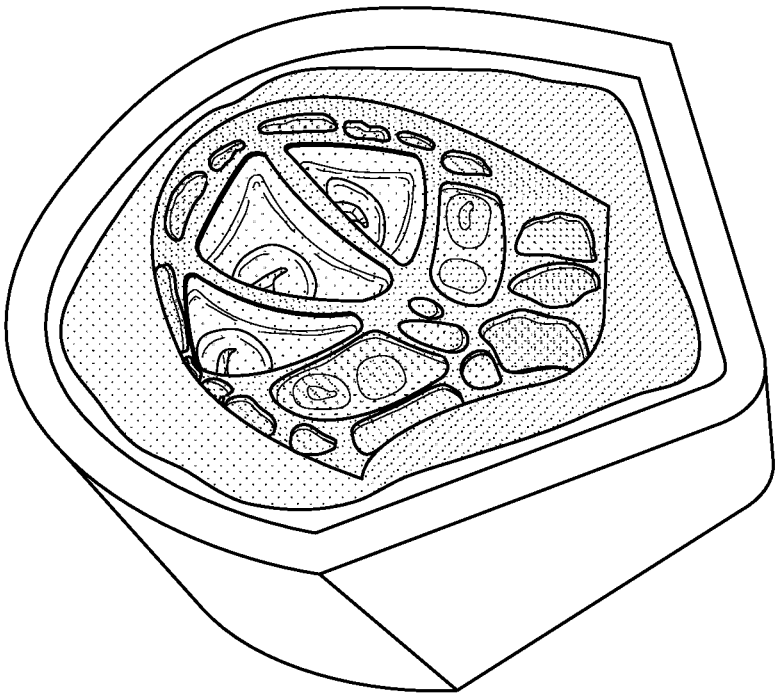
FIG. 9 shows results of having performed additional deformation using the mold extender of FIG. 8.
Figure 10:
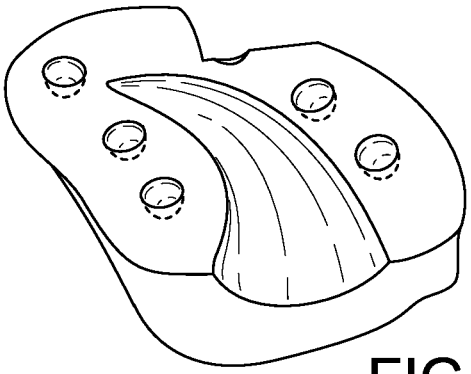
FIG. 10 shows an outer mold for a spike where the outer mold has concave shapes to facilitate alignment with a corresponding inner mold.
Figure 11:
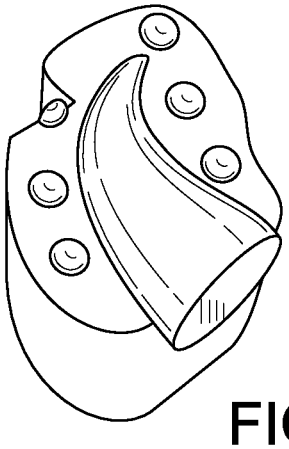
FIG. 11 shows an inner mold that is the complement to the outer mold of FIG. 10, where the inner mold has convex shapes that complement the concave shapes of FIG. 10 to facilitate alignment of the inner mold and outer mold.
Figure 12:
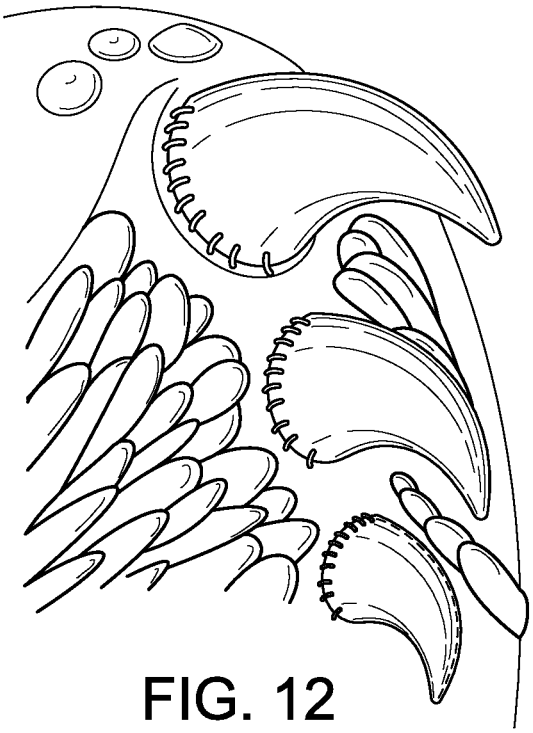
FIG. 12 shows an article of clothing with leather spikes produced using the inner mold and outer mold of FIGS. 10 and 11.

In some examples, mold extenders, are used to provide additional detail to the portions of the leather being deformed. A mold extender, in an embodiment, is smaller than the corresponding inner mold and has additional surface detail, such as additional protrusions from larger protrusions. Note that mold extenders may also be shaped to cause concave surface features. FIG. 7 shows an example mold extender. In some examples, the mold extender is placed between the inner mold and the leather before pressure is applied to the inner and outer molds so that pressure is thereby transferred to the mold extender. In other examples, mold extenders are applied with pressure to the leather and outer mold (with the leather between the mold extender and the outer mold) without the inner mold. In other examples, mold extenders are between the leather and the outer mold before pressure is applied to the inner and outer molds so that pressure is transferred to the mold extender. An example mold extender is shown in FIGS. 7 and 8, with results shown in FIG. 9.

Graduating Molds—Some designs that contain deep detail or undercut designs, the process can require gradual molds to form the leather in progressive stages that prevent tearing and wrinkling during the molding process. FIG. 1 illustrates a cut-away view of leather being formed through a graduating (also referred to as graduated) molds, where each successive application of a graduated mold causes greater deformation in the leather. Depending on the final design and detail, a progression of both Inner and outer molds can be used to slowly form the leather into the desired final shaped, at which time elastomers and/or other shape-maintaining substances may be used. FIG. 1 shows an example incremental mold series to gradually deform leather into a semi-oval-like shape. FIGS. 2A-2C show leather after having gone through successive applications of graduating molds. In some embodiments, the hardness of the inner mold and/or outer mold changes hardness as graduations are made. For instance, in an embodiment, the inner mold gets less hard as graduations are introduced. In another example, the inner mold gets harder as graduations are introduced. In yet another example, the outer mold gets harder as graduations are introduced. In yet another example, the outer mold gets less hard as graduations are introduced. In some examples one of the inner mold or outer mold has a constant hardness as the other of the inner mold or outer mold changes hardness as graduations are introduced. In yet other examples, the inner mold gets harder while the outer mold gets softer, or vice versa, as graduations are introduced. In some embodiments, the negative mold is always harder than the negative mold as graduations are introduced.

Preparing the Material

In an embodiment, a procedure for preparing the material is as follows. Cut out the piece(s) of leather larger than the mold, such as approximately 1-2" or at least as large as the mold. In some examples, the leather can be smaller than the mold, such as when a piece of molded material smaller than the mold surface is desired.

Loosely place the leather face down into the Outer Mold.

Spray the organic leather stretch solvent, such as Sellari's™ shoe stretch, until the leather is completely saturated. The operator may use his/her hands to gently press the leather into the outer mold, although such may be automated by machinery in a high-production environment. The stretch solvent may pool, which indicates the material is sufficiently saturated. Depending on the characteristics of the material and desired hardness properties, water can work as a softener in some embodiments.

Forming

In an embodiment, the prepared leather is formed as follows. Plastic Layer—Place a thin layer of plastic, such as plastic wrap, with an approximate thickness of 8-13 micrometers on the facedown leather now in the outer mold, this will prevent the inner mold from sticking to the leather.

Note that other, non-plastic, materials that will also prevent the inner mold from adhering to the leather may also be used and, in some embodiments, the layer of plastic or other material is configured with design elements (made by varying thickness) to cause small deformations while in the mold.

Place the inner mold into the outer mold and align the two molds so that convex portions of one mold align with respective concave portions of the other mold. The mold may have special interlocking alignment keys to ensure the proper alignment between the upper and inner molds. To prevent wrinkles, if desired, the molds may be hand-pressed together and the extra 1-2" of extra leather can be lightly pulled.

Apply Pressure—Place the outer and inner molds between two pieces of wood or metal or other material, which helps distribute the pressure. In some embodiments, the mold is configured with structural elements which serve to distribute pressure being applied more evenly across the surface of the mold that shapes the leather. Using either C Clamps, a manual crank, hydraulic press, or other mechanism, apply approximately 6,600 psi of pressure onto the mold. Other pressures may be used and the particular pressure may vary with the material being used and the design being sought.

Allow to set under pressure for 24 Hours. In some embodiments, pressure is gradually increased over a period of time (e.g., from zero to approximately 6,600 psi over 36 hours) to prevent ripping or other effects caused by sudden application of pressure. When at full pressure, the leather may be allowed to set under pressure or, in some embodiments, the leather is sufficiently set when the pressure reaches its maximum. In some embodiments, a material accelerator is applied to the leather to reduce the time the leather is under pressure, in some instances as little as 10 minutes. In other examples, a heat-set film is applied and heat and pressure are applied simultaneously to help set the leather quickly in a way where the heat-set film helps support the leather to maintain a shape after deformation. In some embodiments, stretch leather (e.g., leather produced by stretching leather and knit textile binding both together to create a "micro-accordion" effect in the leather, giving the leather the properties of the stretch knit. In some embodiments, a similar technique is applied with a textile that can be easily stretched and bonded within the 3D mold, in some examples without stretch.

Open Mold—Inspect how well-formed the leather has taken the detail. It is common to re-saturate, and re-press the leather 2-3 more times to achieve desired detail.

Introduce Thermoset Elastomer

In an embodiment, a process for introducing a thermoset elastomer is as follows. Separate inner mold and remove the plastic layer from back side of leather. Depending on the absorption of the leather solvent, allow the leather to dry. Do not allow to dry completely, as the leather will most likely shrink out of the mold, unless this shrinking is a desired final product.

Introduce thermoset rubber, such as using a brush or spray, in the desired thickness. Thermoset elastomers include silicones and polyurethanes. To enhance elastomer penetration, the material may undergo another round of pressing to further push the material into backside of the leather. In this case, the pressing will occur at a specific point in elastomer catalyzing, to prevent the material from soaking into the front side of the leather. Note that various techniques, such as brushed on polyurethane and, generally, organic elastomers, can be used. Other options include, but aren't limited to shape-maintaining materials that can be brushed, poured, or otherwise applied (e.g., in a film, such as a heat-set film or a chemical-set film) to the leather to cause the leather to maintain its shape after molding. Such materials may also be combined to simultaneously take advantage of different properties that each has.

To enhance the structure of the leather, operator may set in a textile such as felts or canvas, for additional strength or support.

Finished Molding

In an embodiment, a process for finish molding is as follows. Upon catalyzation, open mold, carefully remove the leather. The leather is now ready to be trimmed and assembled into product. Some embodiments involve 'stack' pressing multiple pieces of leather together, for instance, to put multiple colors in one design. The process can be done in whole or in part to achieve a variety of designs.

As one skilled in the art will appreciate in light of this disclosure, certain embodiments may be capable of achieving certain advantages, including some or all of the following: greater pronounced surface effects in leather; more efficient production of leather with surface ornamentation; fewer materials needed to maintain leather in a desired shape, and other advantages.

The specification and drawings are, accordingly, to be regarded in an illustrative rather than a restrictive sense. It will, however, be evident that various modifications and changes may be made thereunto without departing from the broader spirit and scope of the invention as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed but, on the contrary, the intention is to cover all modifications, alternative constructions, and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. Similarly, use of the term "or" is to be construed to mean "and/or" unless contradicted explicitly or by context. The terms "comprising," "having," "including," and "containing" are to be construed as open-ended terms (i.e., meaning "including, but not limited to,") unless otherwise noted. The term "connected," when unmodified and referring to physical connections, is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal. The use of the phrase "based on," unless otherwise explicitly stated or clear from context, means "based at least in part on" and is not limited to "based solely on."

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood within the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context. In addition, unless otherwise noted or contradicted by context, the term "plurality" indicates a state of being plural (e.g., "a plurality of items" indicates multiple items). The number of items in a plurality is at least two but can be more when so indicated either explicitly or by context.

Operations of processes described herein can be performed in any suitable order unless otherwise indicated herein or otherwise clearly contradicted by context. In an embodiment, a process such as those processes described herein (or variations and/or combinations thereof) is performed under the control of one or more computer systems configured with executable instructions and is implemented as code (e.g., executable instructions, one or more computer programs or one or more applications) executing collectively on one or more processors, by hardware or combinations thereof. In an embodiment, the code is stored on a computer-readable storage medium, for example, in the form of a computer program comprising a plurality of instructions executable by one or more processors. In an embodiment, a computer-readable storage medium is a non-transitory computer-readable storage medium that excludes transitory signals (e.g., a propagating transient electric or electromagnetic transmission) but includes non-transitory data storage circuitry (e.g., buffers, cache, and queues) within transceivers of transitory signals. In an embodiment, code (e.g., executable code or source code) is stored on a set of one or more non-transitory computer-readable storage media having stored thereon executable instructions that, when executed (i.e., as a result of being executed) by one or more processors of a computer system, cause the computer system to perform operations described herein. The set of non-transitory computer-readable storage media, in an embodiment, comprises multiple non-transitory computer-readable storage media, and one or more of individual non-transitory storage media of the multiple non-transitory computer-readable storage media lack all of the code while the multiple non-transitory computer-readable storage media collectively store all of the code. In an embodiment, the executable instructions are executed such that different instructions are executed by different processors—for example, in an embodiment, a non-transitory computer-readable storage medium stores instructions and a main CPU executes some of the instructions while a graphics processor unit executes other instructions. In another embodiment, different components of a computer system have separate processors and different processors execute different subsets of the instructions.

Accordingly, in an embodiment, computer systems are configured to implement one or more services that singly or collectively perform operations of processes described herein, and such computer systems are configured with applicable hardware and/or software that enable the performance of the operations. Further, a computer system, in an embodiment of the present disclosure, is a single device and, in another embodiment, is a distributed computer system comprising multiple devices that operate differently such that the distributed computer system performs the operations described herein and such that a single device does not perform all operations.

The use of any and all examples or exemplary language (e.g., "such as") provided herein is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described herein, including the best mode known to the inventors for carrying out the invention. Variations of those embodiments may become apparent to those of ordinary skill in the art upon reading the foregoing description. The inventors expect skilled artisans to employ such variations as appropriate, and the inventors intend for embodiments of the present disclosure to be practiced otherwise than as specifically described herein. Accordingly, the scope of the present disclosure includes all modifications and equivalents of the subject matter recited in the claims appended hereto as permitted by applicable law. Moreover, any combination of the above-described elements in all possible variations thereof is encompassed by the scope of the present disclosure unless otherwise indicated herein or otherwise clearly contradicted by context.

All references including publications, patent applications, and patents cited herein are hereby incorporated by reference to the same extent as if each reference were individually and specifically indicated to be incorporated by reference and were set forth in its entirety herein.

What is claimed is:

1. A method, comprising:

placing leather between a first negative mold and a first positive mold;

applying pressure to cause the first negative mold and the first positive mold to form an area of the leather;

placing the area of the leather between a second negative mold and a second positive mold, wherein the first negative mold has a higher hardness than the first positive mold; and applying pressure to cause the second negative mold and second positive mold to further form the leather.

2. The method of claim 1, further comprising applying a stretch solvent to the leather prior to placing the leather between the first negative mold and the first positive mold.

3. The method of claim 1, wherein the second positive mold protrudes further from a surface than the first positive mold.

4. The method of claim 1, further comprising applying an elastomer to the leather after applying pressure to cause the second negative mold and the second positive mold to further form the leather.

5. The method of claim 4, wherein the elastomer is a thermoset or organic rubber.

6. The method of claim 4, wherein the elastomer is applied as a sheet that is pressed into the leather.

7. The method of claim 1, wherein applying the pressure comprises increasing the pressure over a period of multiple hours.

8. The method of claim 1, wherein applying the pressure comprises maintaining the pressure for at least multiple hours.

9. The method of claim 1, further comprising applying a textile to provide structural support for the further formed leather.

10. The method of claim 1, further comprising:

placing the area of the leather between a third negative mold and a third positive mold; and applying pressure to cause the third negative mold and third positive mold to further form the leather.

11. The method of claim 10, wherein the first positive mold, the second positive mold, and the third positive mold are graduations toward a destination shape to be molded into the leather.

12. The method of claim 10, wherein the first positive mold, the second positive mold, and the third positive mold have different hardness.

13. The method of claim 1, further comprising saturating the leather with a stretch solvent after further forming the leather.

14. The method of claim 13, further comprising:

placing the area of the saturated leather between the second negative mold and the second positive mold; and applying pressure to cause the second negative mold and second positive mold to further form the saturated leather.

* * * * *